US009927763B2

(12) United States Patent
Domhoff et al.

(10) Patent No.: US 9,927,763 B2
(45) Date of Patent: Mar. 27, 2018

(54) TWO DOOR INTERLOCK MECHANISM FOR AN IMAGING DEVICE

(71) Applicant: LEXMARK INTERNATIONAL, INC., Lexington, KY (US)

(72) Inventors: Joseph Edwin Domhoff, Shelbyville, KY (US); Paul Douglas Horrall, Lexington, KY (US); Alan T. Pullins, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/351,537

(22) Filed: Nov. 15, 2016

(65) Prior Publication Data

US 2017/0308028 A1 Oct. 26, 2017

Related U.S. Application Data

(60) Provisional application No. 62/326,186, filed on Apr. 22, 2016.

(51) Int. Cl.

| | |
|---|---|
| ***G03G 21/16*** | (2006.01) |
| ***E05C 9/00*** | (2006.01) |
| ***E05C 3/16*** | (2006.01) |
| ***E05C 7/00*** | (2006.01) |
| ***E05B 65/00*** | (2006.01) |
| ***E05B 47/00*** | (2006.01) |

(52) U.S. Cl.
CPC ..... *G03G 21/1633* (2013.01); *E05B 65/006* (2013.01); *E05C 3/16* (2013.01); *E05C 7/00* (2013.01); *E05C 9/00* (2013.01); *E05B 2047/0068* (2013.01)

(58) Field of Classification Search
CPC ..... G03G 21/1633; G03G 2221/169; E05B 65/006; E05B 2047/0068
See application file for complete search history.

(56) References Cited

U.S. PATENT DOCUMENTS

| | | | | |
|---|---|---|---|---|
| 2011/0182614 | A1* | 7/2011 | Onuma | G03G 21/1633 399/110 |
| 2012/0012445 | A1* | 1/2012 | Ohta | G03G 21/1633 200/50.12 |
| 2016/0291533 | A1* | 10/2016 | Maeda | G03G 21/1633 |

* cited by examiner

*Primary Examiner* — Sandra Brase

(57) ABSTRACT

An imaging device with a two door interlock system for detecting a positional state of orthogonally mounted first and second access doors of the imaging device. The two door interlock system includes a mounting assembly rotatably mounted to a frame of the imaging device and movable by the first access door between a first position and a second position, and an actuator projecting from an inner surface of the second access door, and a sensor positioned on the mounting assembly and providing an output signal that changes between a first state and a second state. The output signal being in the first state when both of the first and second access doors are in their respective closed positions and in the second state when at least one of the first and second access doors are in their respective open positions.

19 Claims, 13 Drawing Sheets

TWO DOOR INTERLOCK MECHANISM FOR AN IMAGING DEVICE

CROSS REFERENCES TO RELATED APPLICATIONS

The present application is related to and claims priority under 35 U.S.C. 119(e) from U.S. provisional application No. 62/326,186, filed Apr. 22, 2016, entitled, "Two Door Interlock Mechanism For An Imaging Device" the content of which is hereby incorporated by reference herein in its entirety and which is assigned to the assignee of the present application.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The field relates generally an imaging device, and, in particular, to door interlock systems.

Description of the Related Art

Imaging devices often have modular designs comprising varying consumer replaceable units (CRUs) such as waste toner cartridges, photoconductive members, and transport belt modules. Over the life of an imaging device, these CRUs may be replaced multiple times as the need arises. Replacing these CRUs typically requires access to the interior of the imaging device.

In addition to replacing CRUs, there may be other times when it is necessary to access the interior of an imaging device. For instance, paper jam errors sometimes require access to interior portions of a paper feed path to clear misfeeds. As a result, imaging devices are often provided with access doors that may be opened or closed to access the interior of the device. Replacing CRUs or correcting paper jams often requires the user to be near high voltage components or laser components. Further, device errors and damage to moving components, hinges, or latch mechanisms may occur when the access doors are not closed and latched properly, thus causing device downtime and/or expensive repairs.

It would be advantageous to use a mechanical system having only one interlock module to detect the positional states of each of two adjacent access doors at one centrally located position. Such design makes the system very robust against manufacturing tolerances and reduces cost.

SUMMARY OF THE INVENTION

Disclosed is an imaging device having a two door interlock system. The imaging device comprises a frame having a first side and a second side positioned orthogonally with respect to the first side and a housing mounted on the frame. The housing includes a first and a second access door pivotally mounted on the first and second sides, respectively. The first and second access doors are movable between respective closed and open positions. The first access door substantially forms a first side of the housing when in the closed position and permits access to an interior of the housing when in the open position. The second access door substantially forms a second side of the housing when in the closed position and permits access to the interior of the housing when in the open position. A two door interlock system is positioned about immediately adjacent vertical edges of the first and second sides of the frame and is operative to detect a positional state of each of the first and second access doors.

The two door interlock system includes a mounting assembly rotatably mounted to the frame of the imaging device and is movable between a first position and a second position when the first access door is in its closed and open positions, respectively. A bias spring is coupled to the mounting assembly for continuously biasing the mounting assembly towards its second position. A plunger assembly projects from an inner surface of the first access door and engages the mounting assembly when the first access door is moved from the open position to the closed position. With the first access door moved to the closed position, the plunger assembly moves the mounting assembly from its second position to its first position against the biasing force of the bias spring. An actuator projects from an inner surface of the second access door and is engageable with a sensor positioned on the mounting assembly when both the first and second access doors are in their respective closed positions. The sensor provides an output signal that changes between a first state and a second state wherein the first state indicates that the first and second access doors are in their respective closed positions and the second state indicates that at least one of the first and second access doors is in its open position.

When the first and second access doors are in their respective closed positions, the actuator engages the sensor causing the output signal thereof to be in the first state. When the second access door is moved from the closed position to the open position while the first access door is in the closed position, the actuator is disengaged from the sensor causing the output signal thereof to change from the first state to the second state to indicate that one of the first and second access doors is in its open position. When the first access door is moved from the closed position to the open position while the second access door is in the closed position, the sensor disengages from the actuator as the mounting assembly is biased to rotate towards the second position causing the output signal of the sensor to change from the first state to the second state to indicate that at least one of the first and second access doors is in its open position.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

FIG. 16A shows with both front and rear latch arms unlatched; FIG. 16B shows a closing force applied to the rear latch arm resulting in the front latch arm being unlatched with the rear latch arm being latched and the side access door remaining in its open position; and, FIG. 16C shows the closing force being applied in the center of the side access door and alternately shows the closing force being applied to the front latch arm resulting in both the front and rear latch arms being latched and placing the side access door in its closed position.

DETAILED DESCRIPTION

Figure 1:
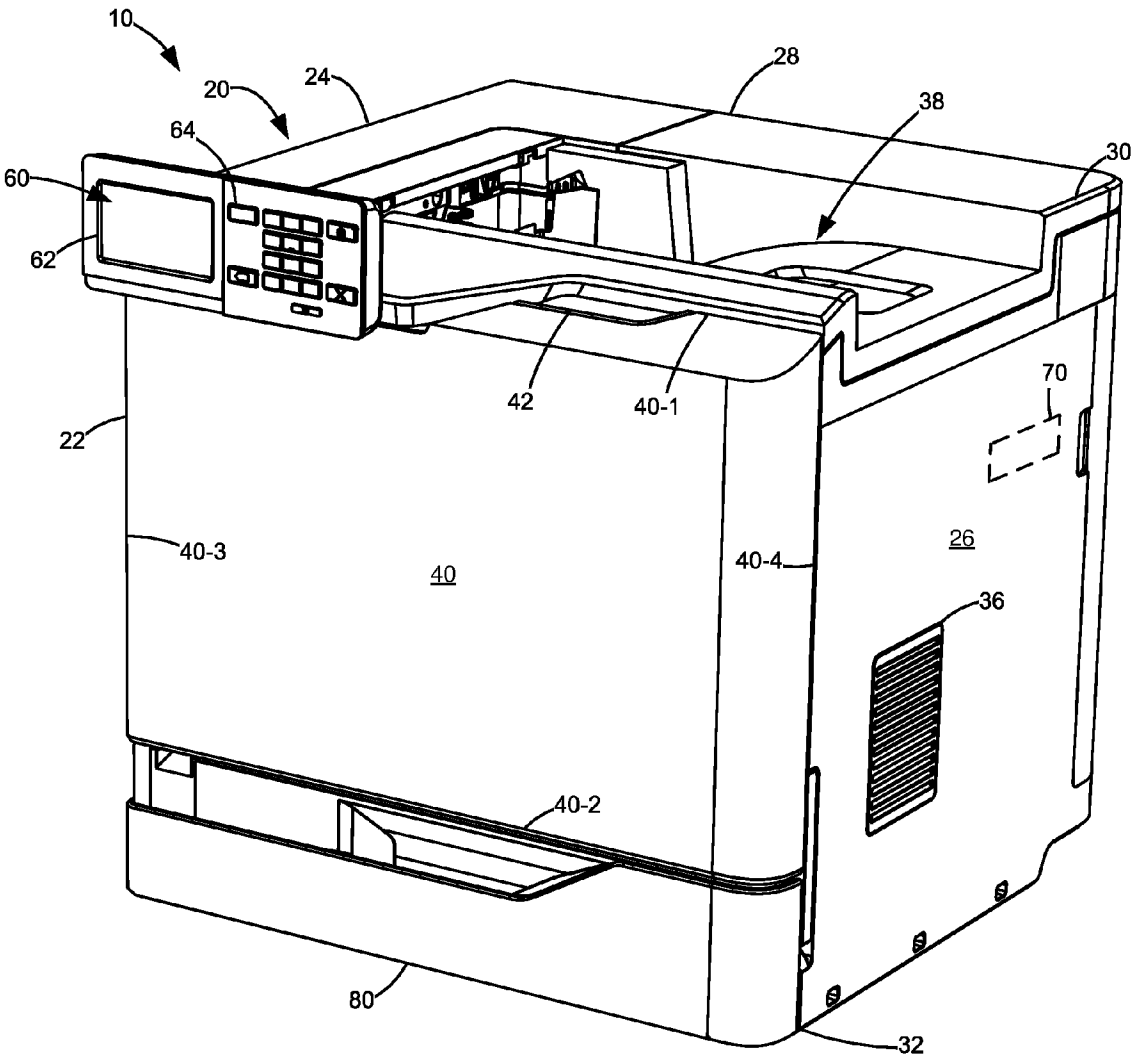
FIGS. 1-2 are right and left side perspective views of an imaging device of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. Furthermore, and as described in subsequent paragraphs, the specific mechanical configurations illustrated in the drawings are intended to exemplify embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed media tray, the top of the media tray is downstream from the bottom of the media tray. Conversely, for a bottom feed media tray, the top of the media tray is upstream from the bottom. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging device, and is generally means from an input toward an output of the imaging device. The terms "front" "rear" "left" and "right" as used herein for a removable media tray and its components are with reference to the removable media tray being inserted in the imaging device as viewed in FIG. 1.

As used herein, the term "communication link" is used to generally refer to structure that facilitates electronic communication between multiple components, and may operate using wired or wireless technology. Communications among components may be done via a standard communication protocol, such as for example, universal serial bus (USB), Ethernet, or IEEE 802.xx.

Figure 2:
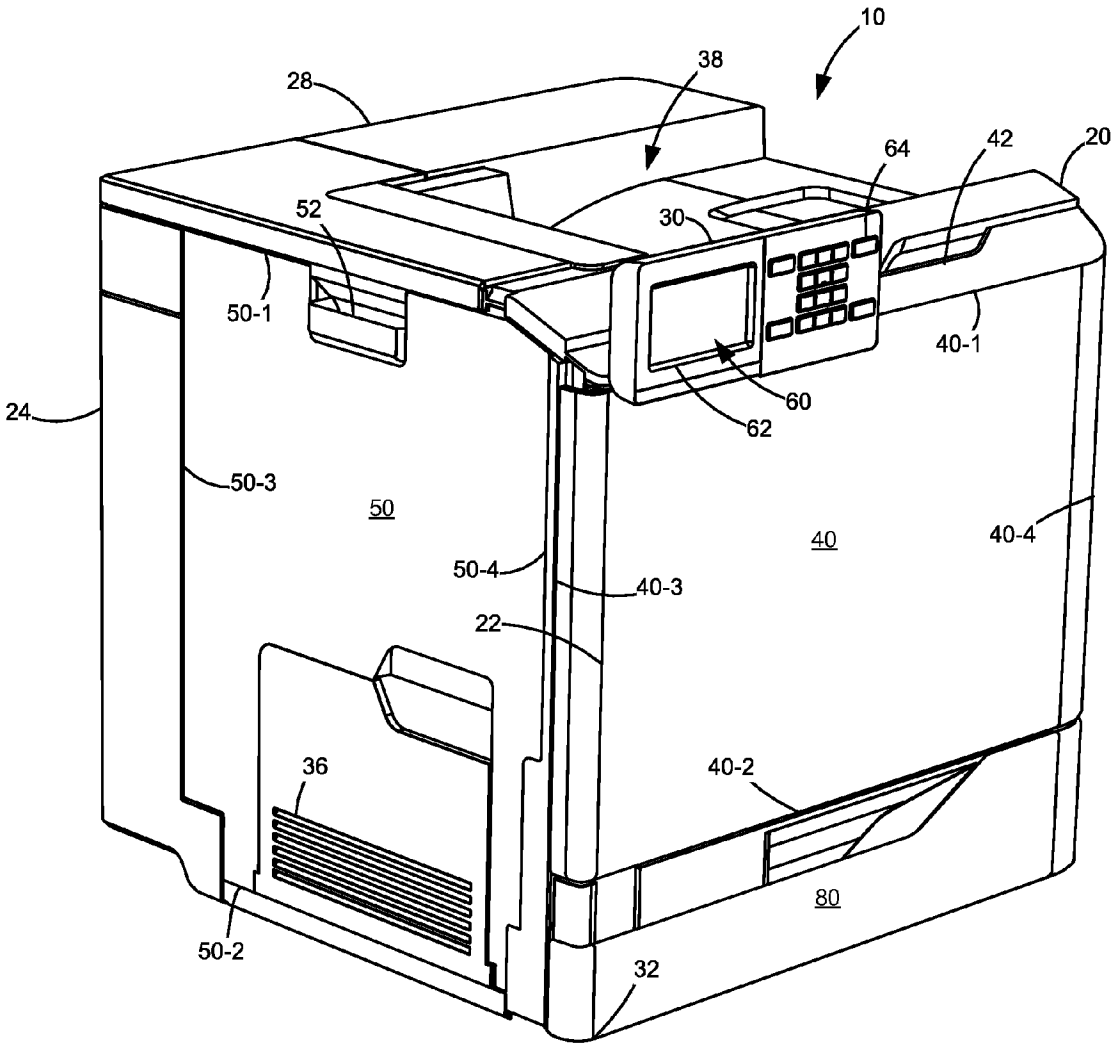
Figure 3:
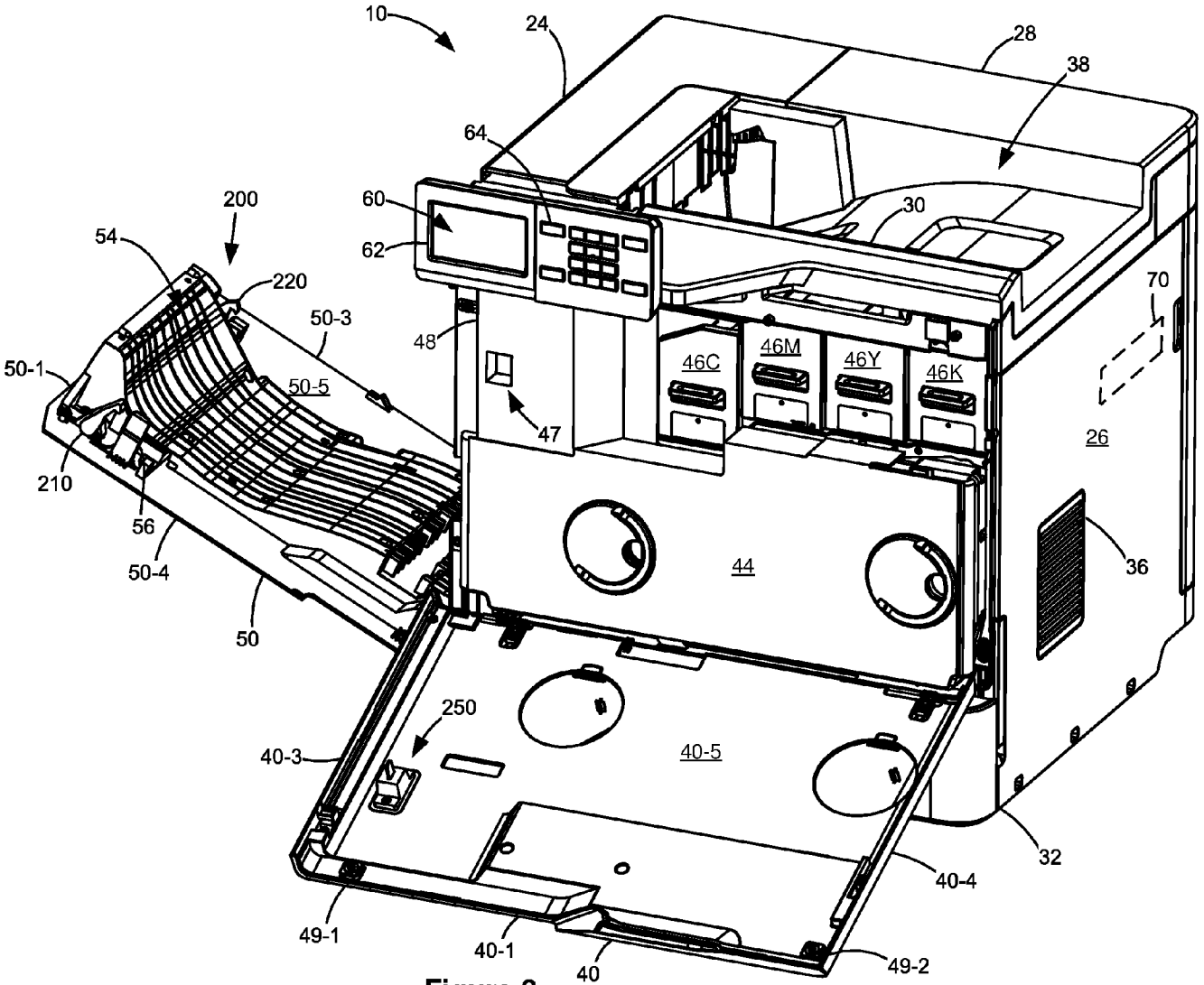
FIG. 3 is a perspective illustration of the imaging device of FIGS. 1-2 having front and side access doors in their open positions.
Figure 4:
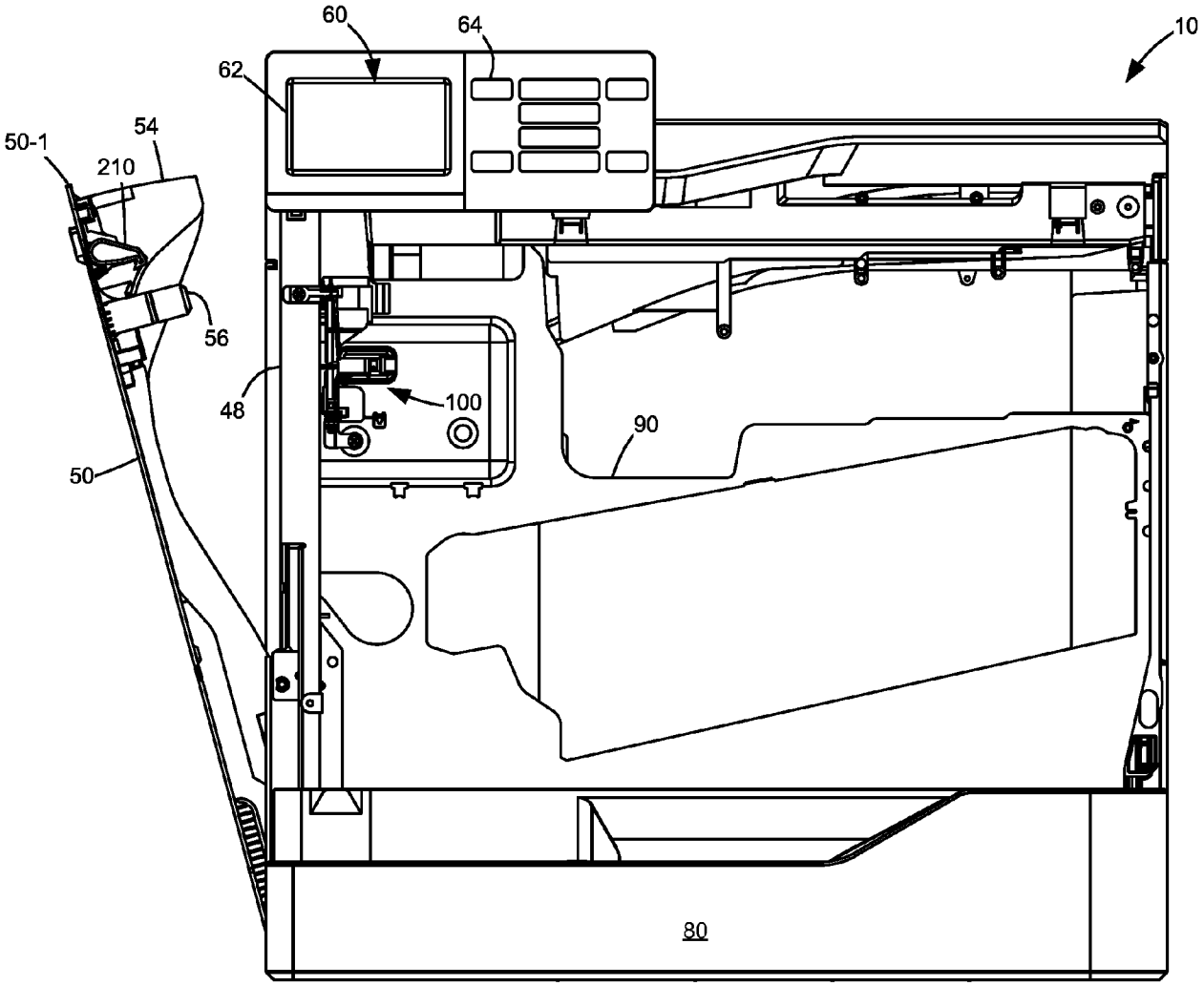
FIG. 4 is a front view of the imaging device of FIGS. 1-2 with the side access door opened and the front access door removed exposing an interlock switch system of the present disclosure.

FIGS. 1-2 illustrate an example imaging device 10 having a housing 20 having a front 22, first and second sides 24, 26, a rear 28, a top 30 and a bottom 32. A media output area 38 is provided in top 30 for printed media exiting imaging device 10. A front access door 40 is mounted on the front 22 of imaging device 10. Front access door 40 has a top edge 40-1, a bottom edge 40-2, a left edge 40-3, and a right edge 40-4. A side access door 50 is provided on the first side 24 on the imaging device 10. Side access door 50 has a top edge 50-1, a bottom edge 50-2, a left or rear edge 50-3, and a right or front edge 50-4. Access door release handles 42, 52 are provided on near top edges 40-1, 50-1 and are used to open front and side access doors 40, 50, respectively, to allow user access into the interior of imaging device 10. Door release handle 52 actuates a latching system, as shown in FIGS. 13-17B, provided on the interior of side access door 50. In FIGS. 1-2, front and side access doors 40, 50 are shown in their raised closed positions while FIG. 3 shows front and side access doors 40, 50 in their lowered open positions. A removable media tray 80 for providing media to be printed is slidably inserted into imaging device 10 below door 40. Also, ventilation openings, such as vents 36 are provided on first and second sides 24, 26 of imaging device 10.

Controller 70 is mounted within imaging device 10 and is used to control operation of imaging device 10, including a drive motor used to rotate one or more feed roll pairs to convey media through imaging device 10, motors for a pick mechanism for feeding media sheets from the removable media tray 80, and imaging operations, such as printing. A user interface 60, comprising a display 62 and a key panel 64, may be located on the front 22 of housing 20. User interface 60 is in operable communication with controller 70. Using the user interface 60, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like. Controller 70 is also configured to work with the two door interlock system of the present disclosure.

Controller 70 includes a processor unit and associated memory and may be formed as one or more Application Specific Integrated Circuits (ASICs). The associated memory may be, for example, random access memory (RAM), read only memory (ROM), and/or non-volatile RAM (NVRAM). Alternatively, the associated memory may be in the form of a separate electronic memory (e.g., RAM, ROM, and/or NVRAM), a hard drive, a CD or DVD drive, or any memory device convenient for use with the controller. Controller 70 may be illustrated in the figures as a single entity but it is understood that controller 70 may be implemented as any number of controllers, microcontrollers and/or processors.

FIG. 3 illustrates imaging device 10 with each of the front and side access doors 40, 50 shown in an open position. The interior of imaging device 10 may contain a number of detachable consumer replaceable units (CRUs) accessible via front access door 40. In the example embodiment, a waste toner container 44 for storing excess toner and toner cartridges 46C, 46M, 46Y, 46K for use in an imaging operation are shown to be inserted within the interior of front access door 40. Each of the toner cartridges 46C, 46M, 46Y, 46K corresponds to a particular ink color, i.e., cyan, magenta, yellow, and black, respectively. An opening 47 is provided through an interior front panel 48 which covers interlock switch system 100 (shown in FIGS. 5-6). A plunger assembly 250 is mounted on an inner surface 40-5 of front access door 40. When front door 50 is in its closed position, plunger assembly 250 is aligned with opening 47 for passage therethrough to engage with interlock switch system 100. Access door latches 49-1, 49-2 are provided on the inner surface 40-5 near top edge 40-1 at each side edge 40-3, 40-4 of front access door 40 and are used to hold front access door 40 in its closed position. In the example shown, access door latches 49-1, 49-2 are comprised of magnets. Although the example illustrated shows a magnetic latch for latching front access door 40 in the closed position, it will be appreciated that other latching mechanisms maybe utilized.

Side access door 50 includes a latching system 200 mounted on an interior surface 50-5 of side access door 50. Latching system 200 includes two pivotally mounted latch arms 210, 220 that engage with correspondingly aligned catches 215, 225, respectively, (see FIG. 16A for example). Features of latching system 200 will be later described with reference to FIGS. 13-17B. A plurality of parallel ribs 54 are provided on the inner surface 50-5 of side access door 50 and serve as media guides along a duplex portion of a media path when side access door 50 is raised into its closed position. An actuator 56 extends from inner surface 40-5 and is positioned near first latch arm 210 for engaging the interlock switch system 100 when front and side access doors 40, 50 are both raised into their respective closed positions. Actuator 56 is a generally planar member.

Figure 5:
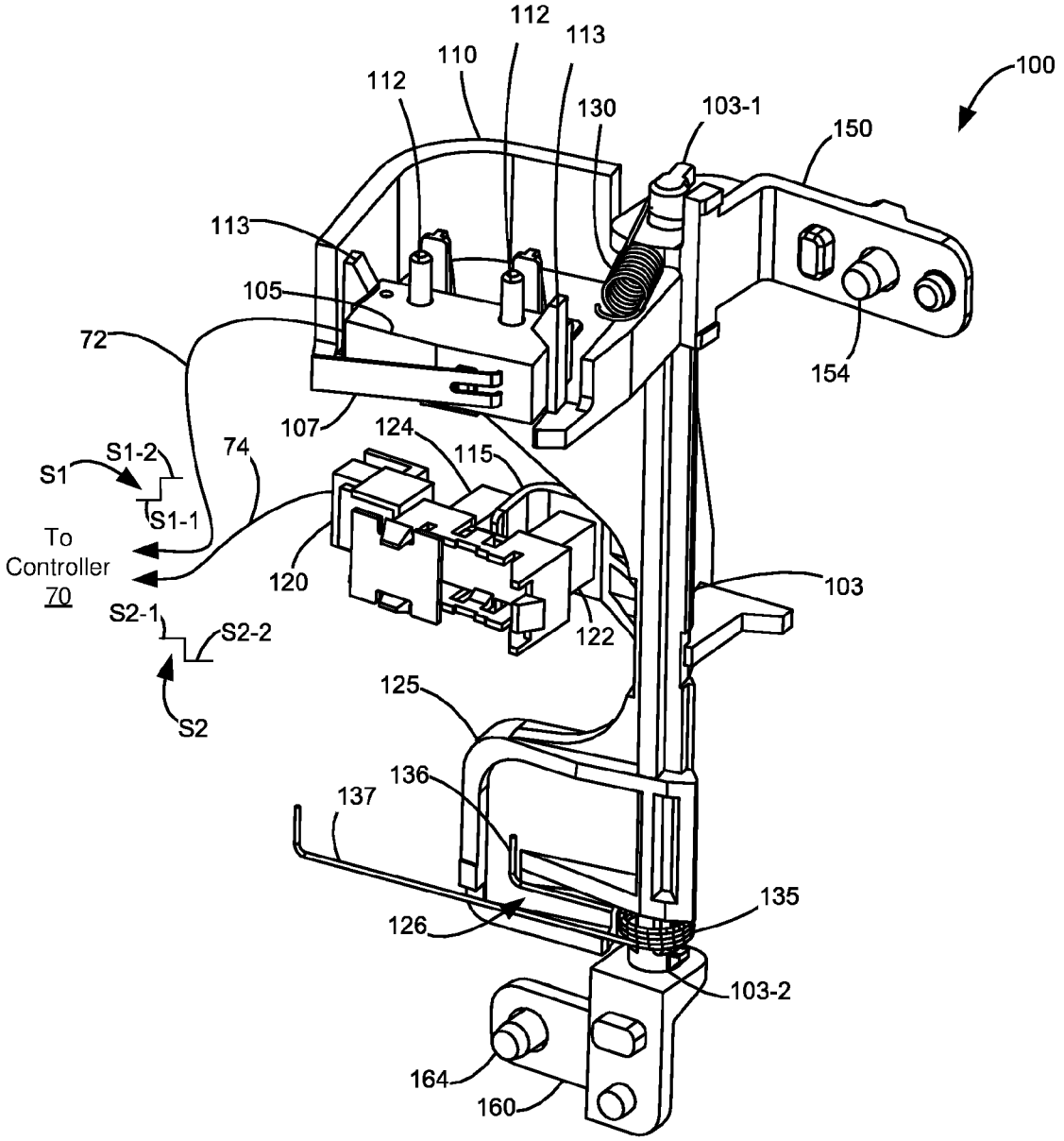
FIG. 5 is a rear perspective view of one form of the interlock switch system of the present disclosure.

With reference to FIGS. 4-10, interlock switch system 100 is shown mounted to frame 90 within imaging device 10. Interlock switch system 100 includes a mounting assembly 103 pivotally attached to frame 90 via top and bottom pivot mounts 150, 160. Mounting assembly 103 is positioned on frame 90 adjacent to the left edge 40-3 of front access door 40 and the front or right edge 50-3 of side access door 50. Interlock switch system 100 also includes at least one sensor for sensing the positions of the access doors 40, 50. As shown, two switches are provided. Switch 105 is mounted on mounting assembly 103 and a switch 120 is mounted on frame 90. Switch 105 is a snap action switch actuated by an attached lever 107 while switch 120 is shown as a photo-interrupter switch that is actuated by mounting assembly 103. In an example embodiment, each of the switches 105, 120 may be communicatively coupled to controller 70 via communication links 72, 74 as shown in FIG. 5. Switches 105, 120 provide output signals S1, S2 to controller 70. Output signal S1 has first and second states S1-1, S1-2 that are representative of positional information (open/closed or closed/open) of side access door 50 and output signal S2 has first and second states S2-1, S2-2 representative of positional information of front access door 40. In another example embodiment, each of the switches 105, 120 may be communicatively coupled to controller 70 via the same communication link.

Mounting assembly 103 has top and bottom ends 103-1, 103-2 that are received into openings 152, 162 provided in top and bottom pivot mounts 150, 160, respectively. Top pivot mount 150 is fastened to frame 90 via opening 156 by a fastener 154. Top pivot mount 150 includes a slotted opening 152 for receiving top end 103-1 of mounting assembly 105. Slotted opening 152 allows the top of mounting assembly 103 some translation movement. Bottom pivot mount 160 is fastened to frame 90 via opening 166 by a fastener 164. Opening 162 is circular and receives the bottom end 103-2 of mounting assembly 103 allowing bottom end 103-2 to rotate therein. An upper bias spring 130 is mounted between the top end 103-1 of mounting assembly 103 and frame 90 of imaging device 10 for biasing the top end 103-1 towards frame 90. Upper bias spring 130 allows the top portion of the mounting assembly 103 to pivot into its closed position but also translate within slotted opening 152 when moving into this position. This allows the top 103-1 of the mounting assembly 103 that controls the location of switch actuator 107 on switch 105 to be referenced directly to the actuator 56. This advantageously eliminates all mechanical tolerances between the mounting assembly 103, switch 105 and the switch actuator 107. One skilled in the art would recognize that other forms of pivot mounts can be used to the same effect and that the illustrated pivot mounts are not considered to be a limitation of the design.

A switch mount 110 for switch 105 is provided proximate to top end 103-1 of mounting assembly 103. Switch mount 110 includes a surface 111 having a pair of rods 112 and a pair of latching posts 113 projecting from surface 111. Switch 105 includes a pair of openings 106 that align with the pair of rods 112. Switch 105 is mounted via openings 106 on the pair of rods 112 and secured in place by the pair of latching posts 113. Switch 105 and its actuator 107 engage with actuator 56 through an opening 95 of frame 90 (see FIG. 9). A flag arm 115 extends from a middle portion of the mounting assembly 103 and is positioned to engage with a photo interrupter switch 120 attached to frame 90 within imaging device 10. A contact arm or plate 125 is attached proximate to bottom end 103-2 and positioned to be contacted by plunger 255 when front access door 40 is in its raised closed position rotating mounting assembly 103 into its first position. A lower bias spring 135, having first and second legs 136, 137, is mounted on mounting assembly adjacent the bottom end 103-2 thereof. First leg 136 is received in a channel 126 provided on contact plate 125 (see FIG. 5) while second leg 137 is engaged with a hook 139 (see FIG. 9) on frame 90. Bias spring 135 continuously biases the mounting assembly 103 to rotate towards its second position away from frame 90 such that flag arm 115 rotates away from engagement with photo interrupter switch 120 when front access door 40 is moved to its open position.

Figure 6:
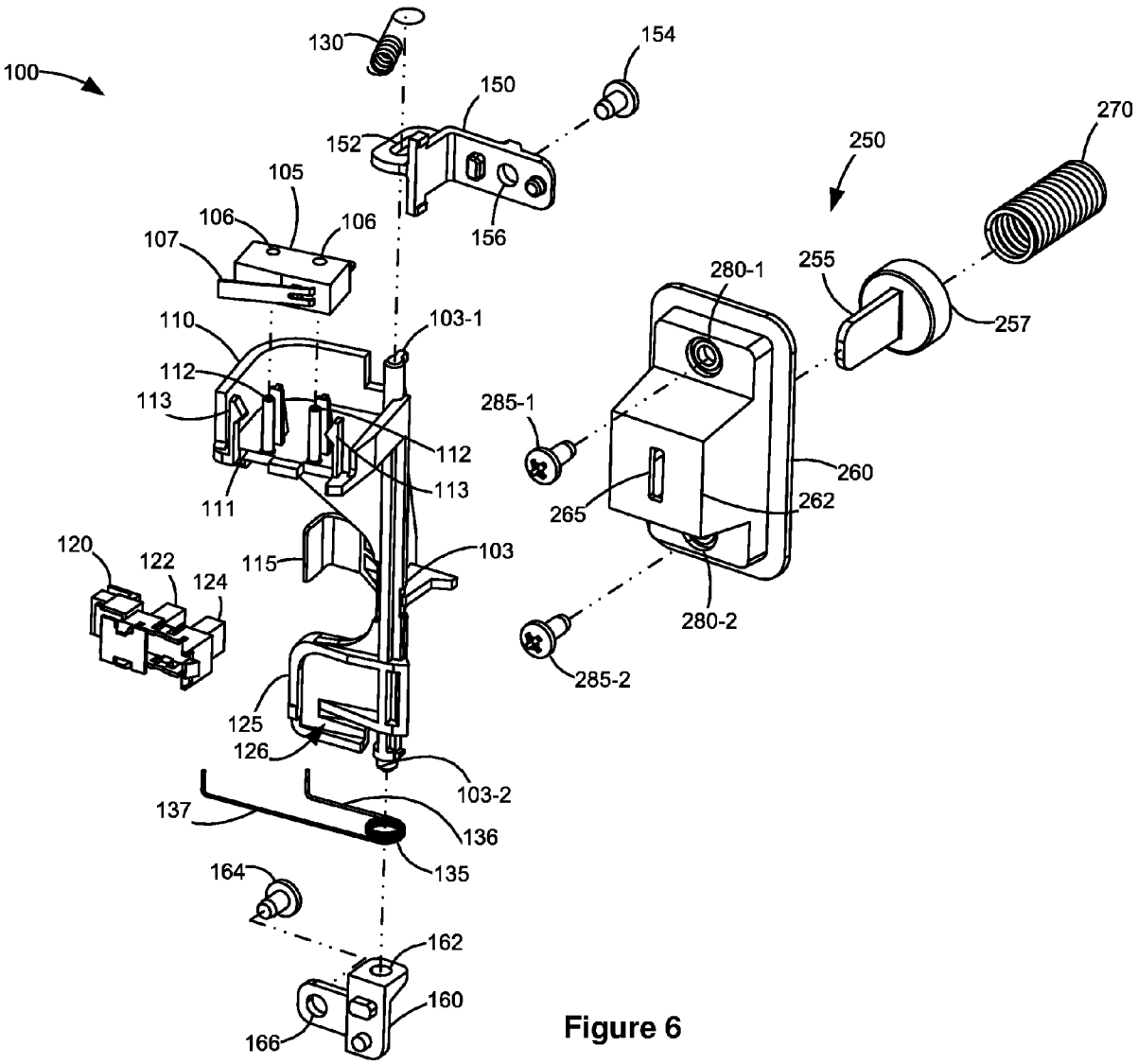
FIG. 6 is an exploded view of the interlock switch system of FIG. 5.
Figure 7:
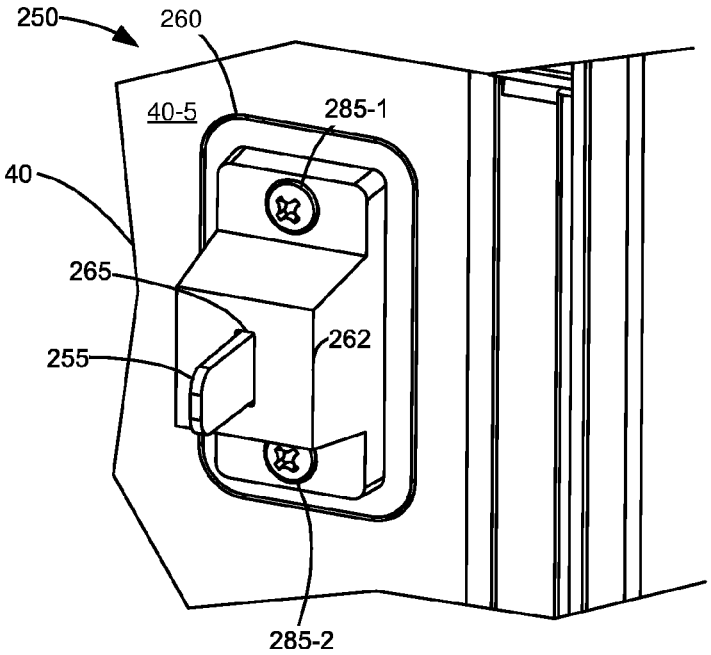
FIG. 7 is a perspective view of a plunger assembly of the imaging device of FIGS. 1-2.
Figure 8:
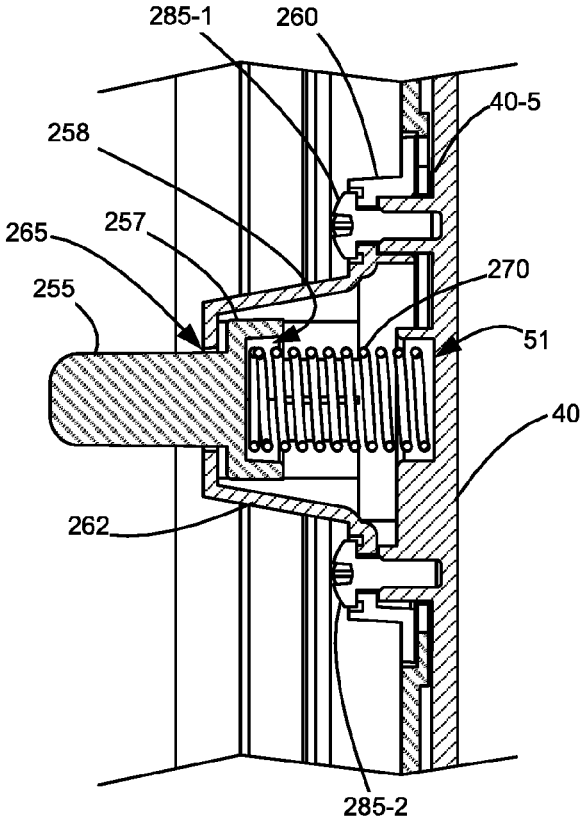
FIG. 8 is a cross-sectional view of the plunger assembly of FIG. 7.

Referring to FIGS. 6-8, plunger assembly 250 is shown. Plunger assembly 250 is comprised of a base 260 having openings 280-1, 280-2 through which respective screws 285-1, 285-2 are inserted for attaching plunger assembly 250 to the inner surface 40-5 of front access door 40. Plunger assembly 250 includes a raised hollow central portion 262 having a slot 265. A plunger 255 is housing within central portion 262. Plunger 255 has at one end thereof a circular base portion 257 having a recess 258 therein. Plunger 255 is inserted through slot 265 and extends away from base 260. A biasing member 270, that is shown as coil spring 270, is positioned between recess 258 and a correspondingly aligned recess 51 provided in the inner surface 40-5 of front access door 40.

Figure 10:
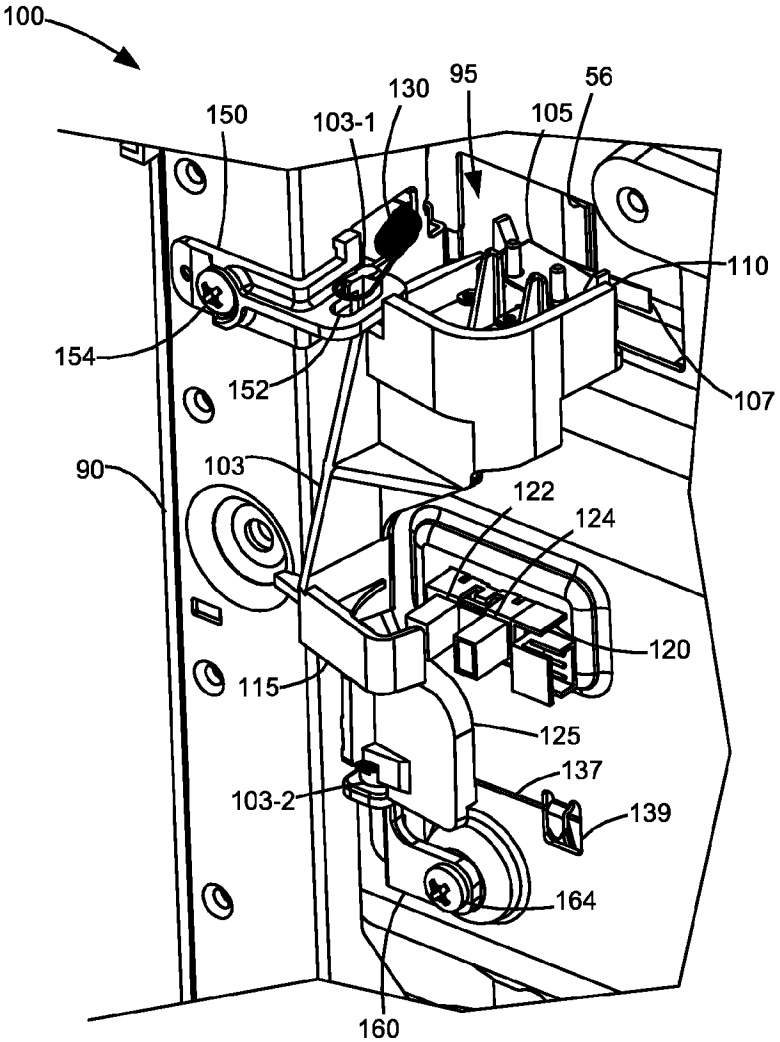
FIGS. 9-10 are perspective views of the interlock switch system of the present disclosure when the front access door is in the closed and open positions, respectively, with the front access door being removed for purposes of clarity.
Figure 9:
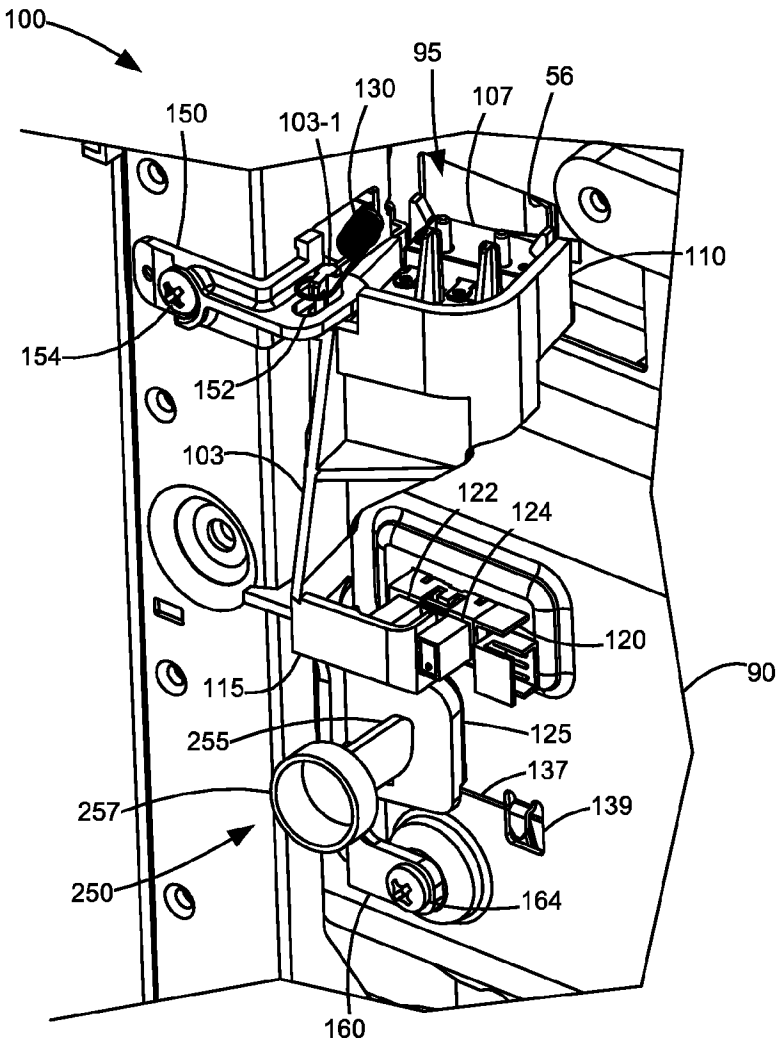
Figure 11:
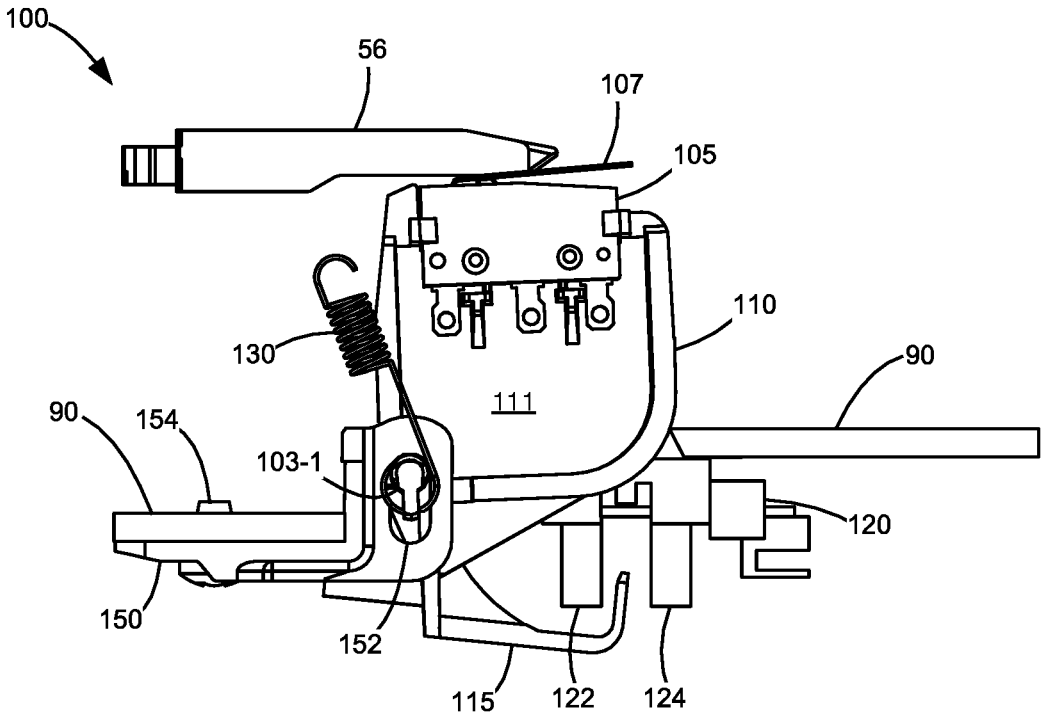
FIGS. 11-12 are top perspective views of the interlock switch system of FIGS. 9-10 when front access door is in the closed and open positions, respectively with the front access door being removed for purposes of clarity.
Figure 12:
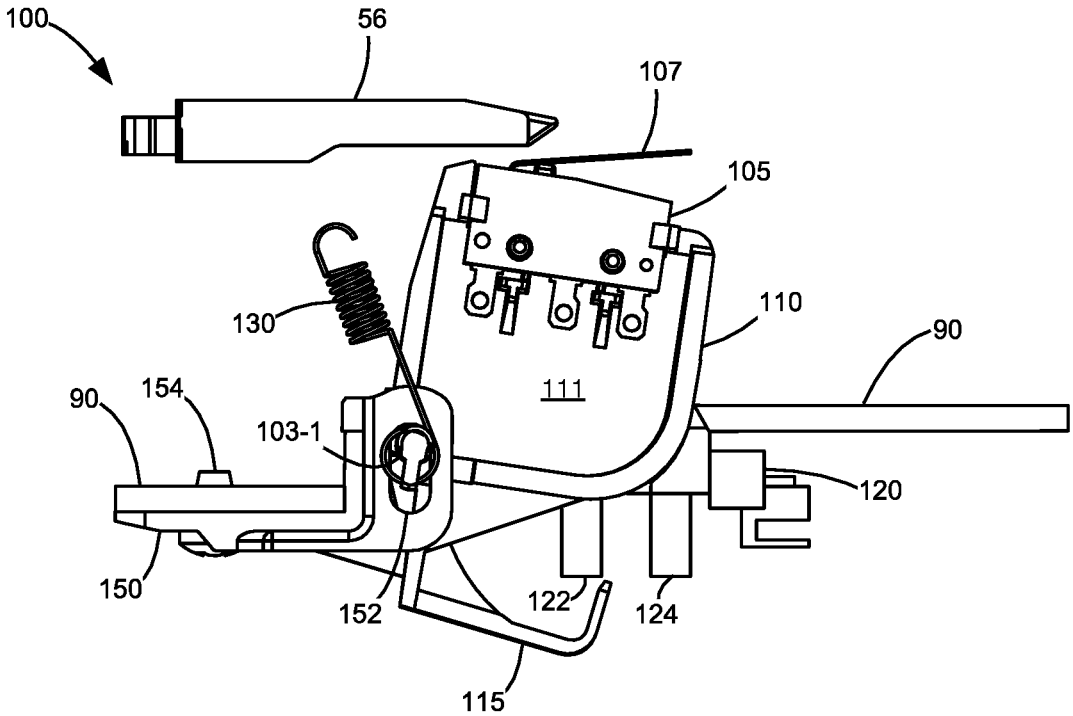

Referring to FIGS. 9-12, operation of interlock system 100 is shown. Mounting assembly 103 is movable between a first position and a second position. When front access door 40 is in its closed position, mounting assembly 103 is rotated and moved to its first position shown as abutting frame 90 as seen in FIGS. 9 and 11. When front access door 40 is in its open position, mounting assembly 103 is moved to the second position rotated away from frame 90 as shown in FIGS. 10 and 12.

Referring to FIGS. 5, 9 and 11, mounting assembly 103 is shown in its first position with front and side access doors 40, 50 in their respective closed positions. Doors 40, 50 have been removed for purposes of clarity. As shown, access door switch 105 is a snap action switch having a lever 107 biased towards opening 95 of frame 90 by upper bias spring 130. Actuator 56 on side access door 50 depresses lever 107 actuating switch 105 changing the state of its output signal to indicate that front and side access doors 40, 50 are in the closed position. As shown in FIG. 9 plunger 255 pushes against contact plate 125, and, in turn, causes mounting assembly 103 to pivot towards the first position and moves flag arm 115 to engage with the photo interrupter switch 120. In the example embodiment illustrated, photo interrupter switch 120 is an optical sensor having an optical path between a pair of opposed arms comprising an emitter 122, which emits an optical beam of light along an optical path, and a photo-receiver 124, which receives the optical beam from emitter 122, that are spaced to allow flag arm 115 to pass therebetween. However, any suitable sensor may be used including a switch such as switch 105. As flag arm 115 passes between emitter 122 and photo-receiver 124 of photo interrupter switch 120, flag arm 115 breaks the emitted optical beam changing the state of the output signal of photo interrupter switch 120 to indicate that front access door 40 is in the closed position. As a result of the interlock switch system 100 detecting that the front and side access doors 40, 50 are in their respective closed positions, the media path is engaged and controller 70 provides power to imaging device 10 resulting to imaging device 10 becoming operational.

As shown in FIG. 11, switch 105 is actuated by actuator 56 and switch 120 is actuated by flag arm 115 with both front and side access doors 40, 50 being in their closed positions. While front access door 40 is closed, should side access door 50 be moved to its open position moving actuator 56 away from switch 105 as shown in FIG. 12, the output signal S1 of switch 105 would change state indicating that side access door 50 is in its open position while output signal S2 of switch 120 would indicate that front access door 40 is in its closed position.

It will be realized that the output signal of only switch 105 may be used to indicate that both front and side access doors are closed. With side access door 50 closed and front access door 40 open, mounting assembly 103 rotates into its second position, moving switch 105 away from actuator 56 causing the output signal of switch 105 to change state indicating that at least one of the two doors 40, 50 are in an open position.

With reference to FIGS. 10 and 12, both figures show mounting assembly 103 in the second position when front access door 40 is in its open position and side access door 50 is in its closed position. As front access door 40 is moved towards its open position, mounting assembly 103 is pivoted away from frame 90 by lower bias spring 135. In the example embodiment illustrated, access door switch 105 is disengaged from actuator 56 returning lever 107 to its undepressed position. When lever 107 is moved to its undepressed position, an output signal of switch 105 changes state indicating that front access door 40 has been opened. In response, controller 70 removes power from high voltage and laser components allowing safe access to imaging device 10. Flag arm 115 is rotated away from photo interrupter switch 120 restoring the optical beam between emitter 122 and photo-receiver 124 of the photo interrupter switch 120 to provide an output signal to controller 70 indicating that front access door 40 is in the open position.

As shown in FIGS. 3-4 and 13-15, side access door 50 has an access door latching system 200 having first and second latch arms 210, 220 provided on near top edge 50-1 at each side 50-3, 50-4 of side access door 50. Latch arms 210, 220 are used to keep side access door 50 in its closed position. Latching system 200 is more clearly illustrated in FIGS. 13-15. First and second latch arms 210, 220 are mounted to respective ends of link 230 that is cooperatively engaged with door release handle 52. Latch arms 210, 220 engage respective catches 215, 225 mounted on frame 90 when the side access door 50 is moved into its closed position. Biasing springs 232, 234 are provided to bias front and rear latch arms 210, 220 toward their respective engaged positions with their respective front and rear catches 215, 225.

Figure 13:
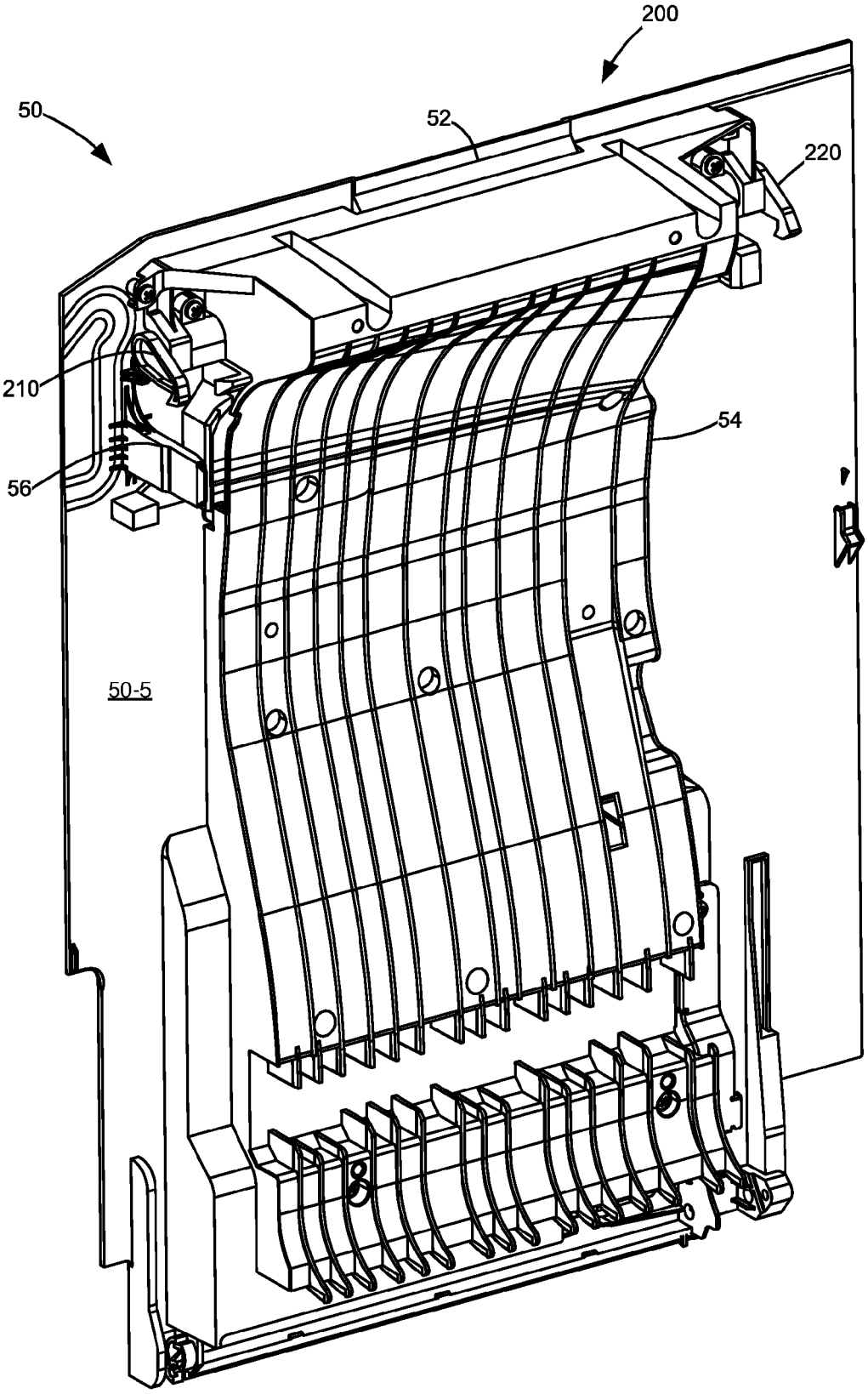
FIG. 13 is a perspective view of the side access door of the imaging device of FIGS. 1-2 showing a door latching mechanism.
Figure 15:
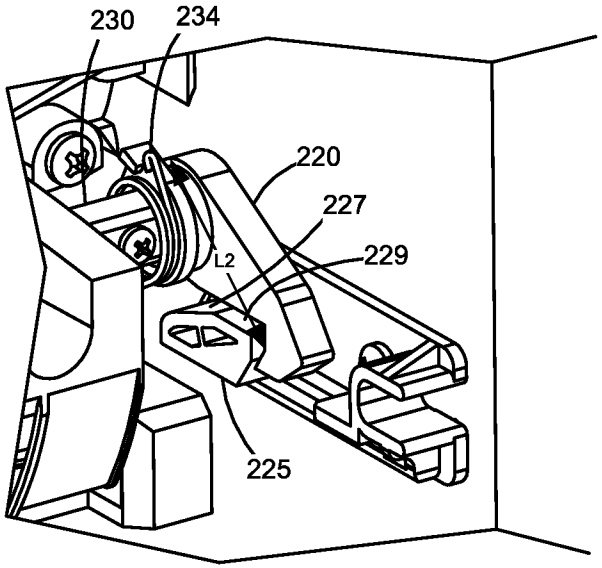
FIGS. 14-15 are enlarged views of the door latching mechanism of the side access door of FIG. 13 having both front and rear latch arms latched.
Figure 14:
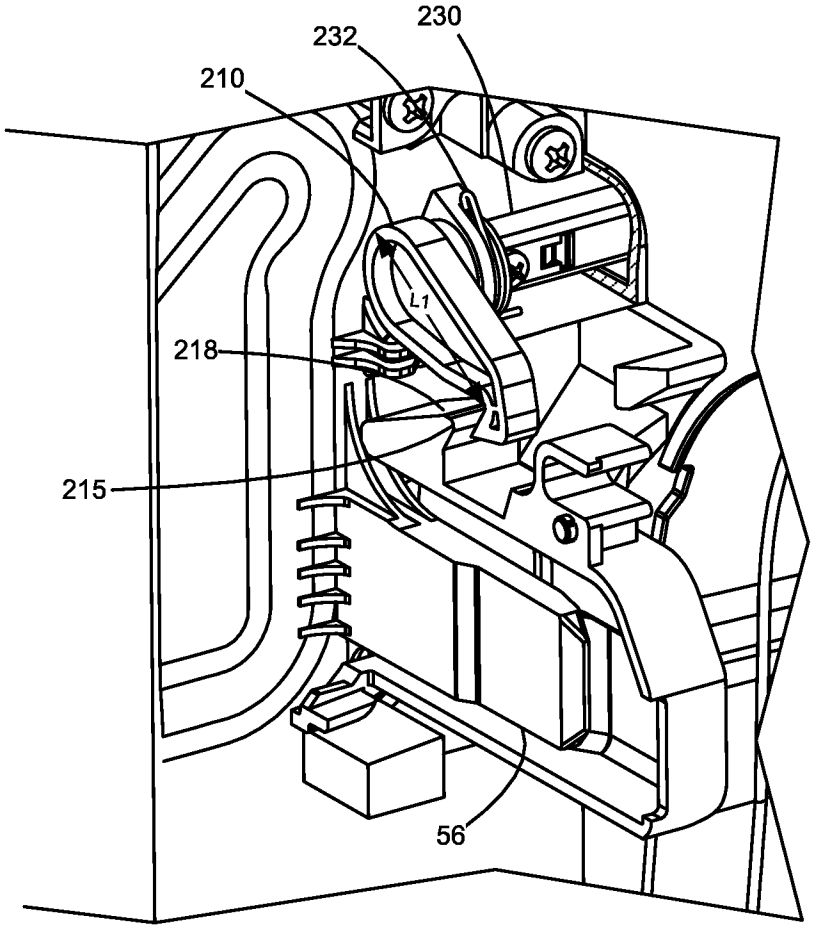

With reference to FIGS. 13-15, access door latching system 200 is shown mounted on the inner surface 50-5 of side access door 50. Spring-biased front and rear latch arms 210, 220 are operatively coupled via link 230 to access door release handle 52 of side access door 50. Front and rear catches 215, 225 are attached to opposing sides of the interior of the imaging device 10 and positioned to receive respective front and rear latch arms 210, 220. Biasing springs 232, 234 are provided to bias front and rear latch arms 210, 220 toward their respective engaged positions with their respective front and rear catches 215, 225. When a symmetric latching design is used wherein both latch arms and their respective catches have the same structural features, both latch arms would require the same amount of force to lock onto their respective catches. However, users have a tendency to apply a pushing force near front latch arm 210 due to the proximity and accessibility of a user for moving side access door 50 towards the closed position. This would allow front latch arm 210 to lock onto front catch 215 while the rear latch arm 220 does not lock onto rear catch 225. A moment is created due to the closing force being applied far from the midpoint between the two latch arms 210, 220 such that the force applied to rear latch arm 220 is insufficient to lock rear latch arm 220 to rear catch 225. As a result, this causes a printing issue since interlock switch system 100 would indicate that side access door 50 is in the closed position due to front latch arm 210 being locked to front catch 215 causing actuator 56 to contact access door switch 105 and depress lever 107 while the paper path is not engaged correctly due to the second latch arm 220 not locking onto second catch 225.

In one example embodiment, access door latching system 200 uses an asymmetric latching design such that when a closing force is applied to side access door 50 near front latch arm 210 to move the side access door 50 towards its closed position, front and rear latch arms 210, 220 both latch onto their respective front and rear catches 215, 225. With the front access door 40 closed and side access door 50 open, as would be the case when a media jam is indicated on user interface 60, when the closing force is applied to side access door 50 near rear latch arm 220, rear latch arm 220 locks onto rear catch 225 without front latch arm 210 locking onto front catch 215 causing actuator 56 to not actuate switch 105 and change the state of signal S1 being sent to controller 70 indicating that side access door 50 remains in its open position. In FIGS. 14 and 15, an example asymmetric latching design of the access door latching system 200 is shown having rear latch arm 220 having a length L2 that is longer than the length L1 of front latch arm 210 with their respective front and rear catches 215, 225 having different surface profiles. The profile of front catch 215 includes a ramped surface 218 (FIG. 14) while the profile of rear catch 225 includes a ramped surface 227 and a flat surface 229 (FIG. 15). This design prevents front latch arm 210 latching with front catch 215 until rear latch arm 220 has already latched onto rear catch 225 and ensures that only when both of the front and rear latch arms 210, 220 are latched onto their respective front and rear catches 215, 225 will cause actuator 56 to depress lever 107 when front access door 40 is also in its closed position.

As access door release handle 52 is actuated to move side access door 50 to its open position, first and second latch arms 210, 220 unlatches from their respective catches 215, 225, allowing side access door 50 to move from the closed position to the open position. In the event that side access door 50 is in the open position and front access door 40 is in the closed position, mounting assembly 103 will still be in the first position as shown in FIG. 5. However, actuator 56 is moved away from access door switch 105, enabling lever 107 of access door switch 105 to return to the undepressed position, providing the output signal to controller 70 for removing power from high voltage and laser components and indicating that only side access door 50 is opened.

Figure 16C:
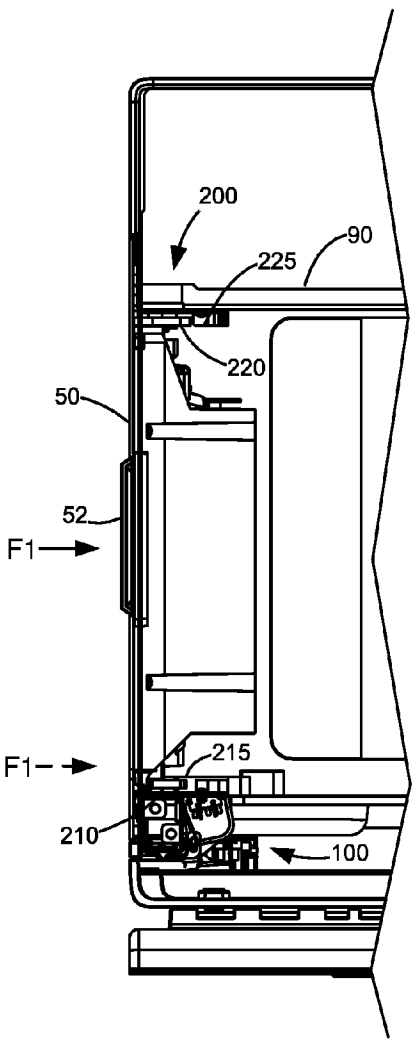
FIGS. 16A-16C show a closing sequence of the side access door where
Figure 16B:
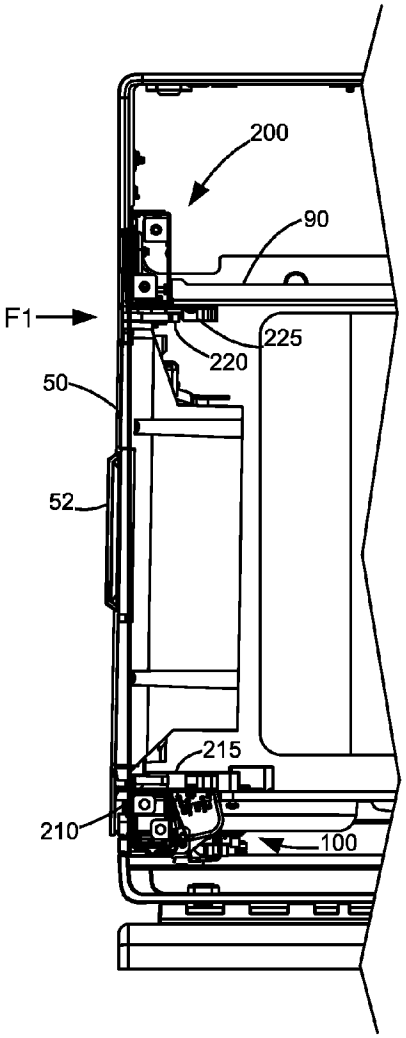
Figure 16A:
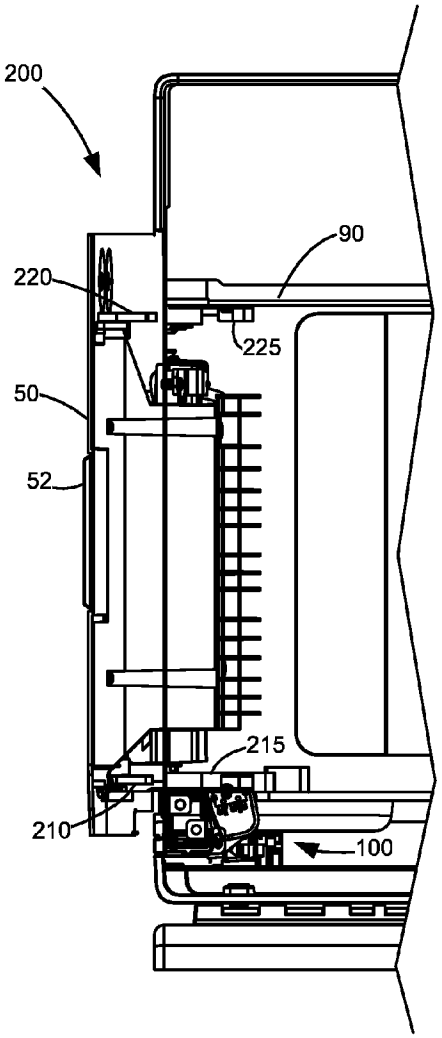
Figure 17A:
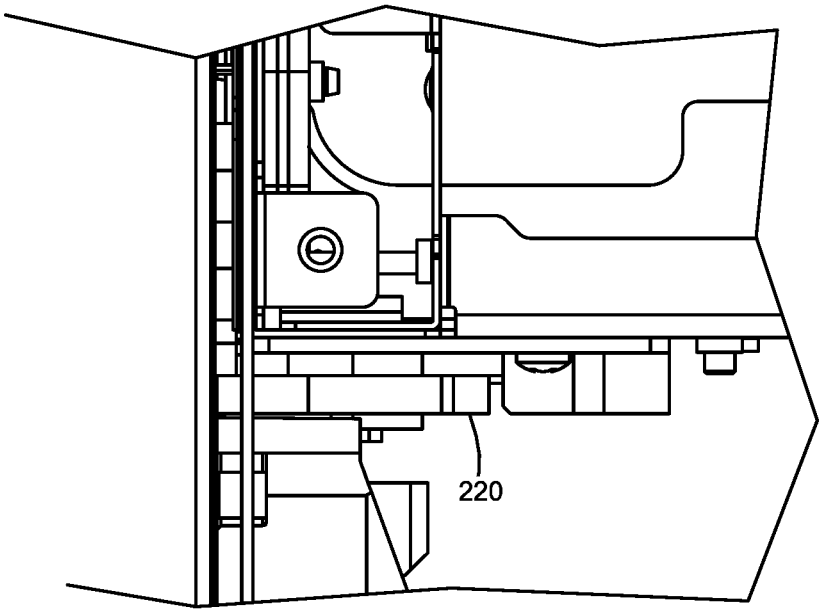
FIGS. 17A-17B are enlarged views of the latching mechanism of the side access door corresponding to the side access door position shown in FIG. 16B where the rear latch arm is latched and the front latch arm unlatched with the side access door still being in its open position.
Figure 17B:
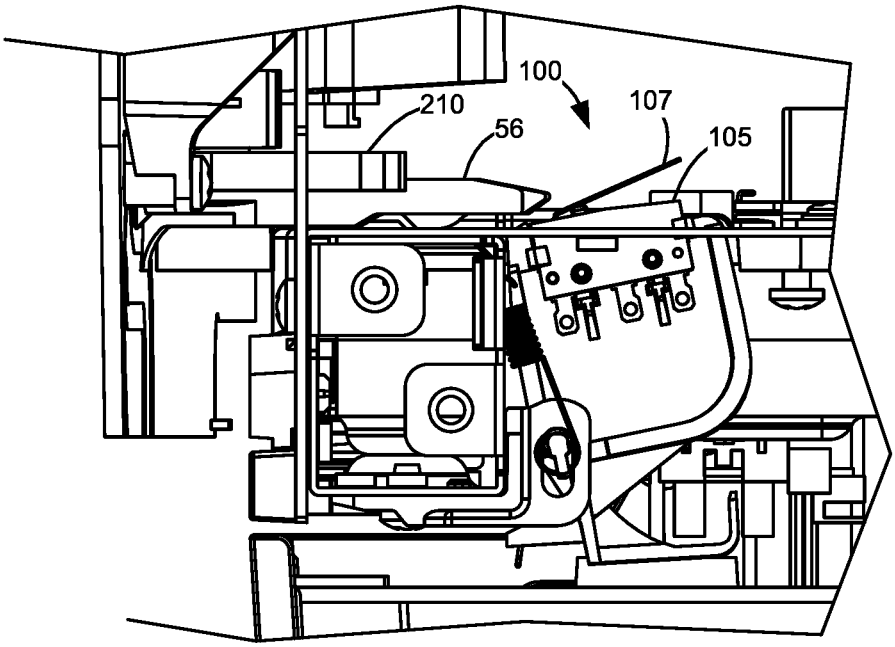

Operation of the asymmetric access door latching system 200 will be briefly discussed with reference to FIGS. 16A-17B. In FIG. 16A, side access door 50 is shown in its open position having front and rear latch arms 210, 220 unlatched from respective front and rear catches 215, 225. FIG. 16B illustrates an incorrect method of closing side access door 50. As shown, a closing force F1 is applied by a user to side access door 50 near rear latch arm 220. When side access door 50 is closed by applying closing force F1 at the indicated location, rear latch arm 220 is latched to rear catch 225 as shown in FIG. 17A. However, as shown in FIG. 17B, front latch arm 210 does not latch onto front catch 215 and actuator 56 is not moved to engage with lever 107 of access door switch 105, retaining side access door 50 in an open or unactuated position. In FIG. 16C, side access door 50 is shown to be successfully moved to its closed position. As shown, closing force F1 is now applied by a user to side access door 50 either near front latch arm 220 or to door release handle 52 causing front and rear latch arms 210, 220 to latch to their respective front and rear 215, 225, as shown in FIGS. 14 and 15, respectively, with actuator 56 contacting and depressing lever 107 of door access switch 105, as shown in FIG. 11, moving side access door 50 to its closed position.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. An imaging device, comprising:

a frame including a first side and a second side positioned orthogonally with respect to the first side;

a housing mounted on the frame, the housing including a first and a second access door each pivotally mounted on the first and second sides, respectively;

the first access door movable between a closed position and an open position, the first access door substantially forming a first side of the housing when in its closed position and permitting access to an interior of the housing when in its open position;

the second access door movable between a closed position and an open position, the second access door substantially forming a second side of the housing when in its closed position and permitting access to the interior of the housing when in its open position; and, a two door interlock system positioned about immediately adjacent vertical edges of the first and second sides and operative to detect a positional state of the first and second access doors, the two door interlock system including:

a mounting assembly rotatably mounted to the frame of the imaging device and movable between a first position and a second position when the first access door is in its closed position and in its open position, respectively;

a bias spring coupled to the mounting assembly for continuously biasing the mounting assembly to rotate towards its second position;

a plunger assembly projecting from an inner surface of the first access door for engaging the mounting assembly when the first access door is moved from its open position to its closed position and moving the mounting assembly from its second position to its first position against the biasing force of the bias spring;

an actuator projecting from an inner surface of the second access door; and, a sensor positioned on the mounting assembly and providing an output signal that changes between a first state and a second state, the output signal being in the first state when both the first and second access doors are in their respective closed positions and in the second state when at least one of the first and second access doors are in their respective open positions, wherein:

when both the first and second access doors are in their respective closed positions, the actuator engages the sensor causing the output signal thereof to be in the first state indicating that both the first and second access doors are in their respective closed positions, moving the second access door from its closed position to its open position while the first access door is in its closed position disengages the actuator from the sensor causing the output signal thereof to change from the first state to the second state indicating that at least one of the first and the second access doors is in its open position, and, moving the first access door from its closed position to its open position while the second access door is in its closed position allows the mounting assembly to rotate toward its second position moving the sensor away from the actuator of the second access door causing the output signal of the sensor to change from the first state to the second state indicating that at least one of the first and second access doors is in its open position.

2. The imaging device of claim 1, further comprising a controller communicatively coupled with the sensor to receive the output signal therefrom.

3. The imaging device of claim 2, wherein, the controller is operative to provide power to the imaging device when the first and second access doors are in their respective closed positions and to remove power from the imaging device when at least one of the first and second access doors is in its open position.

4. The imaging device of claim 2, wherein, the two door interlock further includes a second sensor mounted on the frame, the second sensor positioned to detect whether the mounting assembly is in one of its first and second positions, the second sensor having an output signal being in operative communication with the controller.

5. The imaging device of claim 4, wherein, the second sensor is an optical interrupter type sensor, the output signal of the second sensor having a first state when the mounting assembly is in its first position and a second state when the mounting assembly is in its second position; and the mounting assembly further comprises a flag arm engageable with the second sensor and operative to change the output signal of the second sensor when the mounting assembly is moved between its first and second positions wherein, when mounting assembly is in its first position, the first access door is in one of its open and closed positions, and, when the mounting assembling is in its second position, the first access door is in the other one its open and closed positions.

6. The imaging device of claim 5, wherein, the two door interlock system further includes a spring-biased plunger assembly mounted on the first access door, the plunger assembly having a plunger engageable with the flag arm wherein, when the first access door is in its closed position, the plunger engages the flag arm rotating the mounting assembly into its first position and moving the flag arm into engagement with the first sensor.

7. The imaging device of claim 1, wherein, the sensor further includes a switch having a resilient lever arm for actuating the switch when engaged by the actuator.

8. The imaging device of claim 7, wherein, the frame of the imaging device includes an opening through which the lever arm of the sensor extends when the mounting assembly is in its first position.

9. The imaging device of claim 1 further comprising:

a door latching system for latching the second access door in its closed position, the door latching system including:

a first latch arm pivotally mounted on and extending from a first end portion of the second access door and engageable with a first catch positioned on the frame opposite the first latch arm and immediately adjacent to the front access door when the second access door is moved from its open position to its closed position; and, a second latch arm pivotally mounted on and extending from a second end portion of the second access door opposite the first end portion thereof and engageable with a second catch positioned on the frame opposite the second latch arm when the second access door is moved from its open position to its closed position, wherein, when a closing force is applied to the first end portion of the second access door to move the second access door from its open position to its closed position, the first and second latch arms lock onto the first and second catches, respectively, and when the closing force is applied to the second end portion of the second access door, the second latch arm locks onto the second catch without the first latch arm locking onto the first catch causing the second access door to remain in the open position.

10. The imaging device of claim 9, wherein, the second latch arm has a length greater than the first latch arm.

11. An imaging device, comprising:

a frame including a first side and a second side positioned orthogonally with respect to the first side;

a housing mounted on the frame, the housing including a first and a second access door being pivotally mounted adjacent to respective bottom edges thereof to the first and second sides, respectively;

the first access door movable between a raised closed position and a lowered open position, the first access door substantially forming a first side of the housing when in its closed position and permitting access to an interior of the housing when in its open position;

the second access door movable between a raised closed position and a lowered open position, the second access door substantially forming a second side of the housing when in its closed position and permitting access to the interior of the housing when in its open position;

a door latching system for latching the second access door in its closed position, the access door latching system including:

a first latch arm pivotally mounted on and extending from a first end portion of the second access door and engageable with a first catch positioned on the frame opposite the first latch arm and immediately adjacent to the front access door when the second access door is moved from its open position to its closed position; and, a second latch arm pivotally mounted on and extending from a second end portion of the second access door opposite the first end portion thereof and engageable with a second catch positioned on the frame opposite the second latch arm when the second access door is moved from its open position to its closed position;

and, a two door interlock system positioned about immediately adjacent edges of the first and second sides and operative to detect a positional state of at least one of the first and second access doors, the two door interlock system including:

a mounting assembly rotatably and vertically mounted on a frame of the imaging device and movable between a first position and a second position when the first access door is in its closed position and open positions, respectively;

a bias spring coupled to the mounting assembly for continuously biasing the mounting assembly to rotate towards its second position;

a first sensor positioned on the frame, the first sensor having an output signal having first and second states indicating that the mounting assembly is in its first and second positions, respectively, and indicating that the first access door is in its closed and open positions, respectively;

an actuator projecting from an inner surface of the second access door; and, a second sensor positioned on the mounting assembly and engageable by the actuator when the mounting assembly is in its first position, the second sensor having an output signal, the output signal of the second sensor being in a first state when the second sensor is engaged by the actuator and a second state on the occurrence of at least one of the second access door being in its open position and the first door being in its open position, wherein:

when a closing force is applied on the first end portion of the second access door to move the second access door from its open position to its closed position and the first access door is in its closed position with the output signal of the first sensor being in its first state, the first and second latch arms lock onto the first and second catches, respectively, and the actuator engages with the second sensor causing the output signal thereof to be in its first state with the respective output signals of the first and second sensors indicating that first and second access doors are in their respective closed positions, and, when the closing force is applied on the second end portion of the second access door to move the second access door from its open position to its closed position and the first access door is in its closed position with the output signal of the first sensor being in its first state, the second latch arm locks onto the second catch without the first latch arm locking onto the first catch causing the actuator to not engage with the second sensor placing the output signal of the second sensor in its second state with the respective output signals of the first and second sensors respectively indicating that the first access door is in its closed position and the second access door is in its open position.

12. The imaging device of claim 11, further comprising a controller communicatively coupled with the first and second sensors to receive their respective output signals.

13. The imaging device of claim 12, wherein, the controller is operative to provide power to the imaging device when the first and second access doors are in the respective closed positions and to remove power from the imaging device when at least one of the first and second access doors is in the open position.

14. The imaging device of claim 11, wherein, the second sensor further includes a switch having a resilient lever arm for changing the state of the switch when engaged and disengaged by the actuator.

15. The imaging device of claim 11, wherein, the frame of the imaging device includes an opening through which the lever arm of the second sensor extends when the mounting assembly is in the first position.

16. The imaging device of claim 11, wherein, the first sensor is an optical interrupter type sensor, and the mounting assembly further comprises a flag arm engageable with the first sensor and operative to change the output signal of the first sensor when the mounting assembly is moved between its first and second positions wherein, when mounting assembly is in the first position, the first access door is in its closed position, and, when the mounting assembling is in the second position, the first access door is in its open position.

17. The imaging device of claim 16, wherein, the two door interlock system further includes a spring-biased plunger assembly mounted on the first access door, the plunger assembly having a plunger engageable with the flag arm wherein, when the first access door is in its closed position, the plunger engages the flag arm rotating the mounting assembly and moving the flag arm into engagement with the first sensor.

18. The imaging device of claim 11, wherein, the mounting assembly further includes a switch mount positioned to receive the first sensor.

19. The imaging device of claim 11, wherein, the interlock system further includes:

a bottom and a top pivot mount attached to the frame, the bottom pivot mount having a circular opening for rotatably receiving a bottom end of the mounting assembly and the top pivot mount having a slotted opening therein to rotatably and translateably receiving a top end of the mounting assembly; and, a second bias spring attached between the frame and the top of the mounting assembly.

* * * * *